US007345282B2

(12) United States Patent
Hawman

(10) Patent No.: US 7,345,282 B2
(45) Date of Patent: Mar. 18, 2008

(54) COLLIMATOR WITH VARIABLE FOCUSING AND DIRECTION OF VIEW FOR NUCLEAR MEDICINE IMAGING

(75) Inventor: Eric G. Hawman, Schaumburg, IL (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 196 days.

(21) Appl. No.: 11/236,037

(22) Filed: Sep. 27, 2005

(65) Prior Publication Data

US 2006/0145081 A1 Jul. 6, 2006

(51) Int. Cl.
*G21K 1/02* (2006.01)

(52) U.S. Cl. ..... 250/363.1

(58) Field of Classification Search ..... 250/363.1
See application file for complete search history.

(56) References Cited

U.S. PATENT DOCUMENTS 5,099,134 A * 3/1992 Hase et al. ..... 250/505.1
5,602,395 A * 2/1997 Nellemann et al. .... 250/363.03
6,693,291 B2 * 2/2004 Nelson et al. ..... 250/505.1

FOREIGN PATENT DOCUMENTS

WO WO 2004008968 A1 * 1/2004

OTHER PUBLICATIONS

Marcelo J. Dapino, Frederick T. Calkins, Alison B. Flatau. "Magnetostrictive Devices Standard," Wiley Encyclopedia of Electrical and Electronics Engineering. John Wiley & Sons, Inc, Article Online Posting Date: Dec. 27, 1999.*

* cited by examiner

*Primary Examiner*—Dave Porta
*Assistant Examiner*—Jessica L Eley

(57) ABSTRACT

According to the present invention, a novel slat collimator for use in nuclear medicine imaging is provided. The slat collimator comprises a first layer comprising a plurality of spaced apart elongated slats and a second layer comprising a plurality of spaced apart elongated slats. The slats of the second layer are positioned orthogonally with respect to the slats of the first layer. The slats are constructed of a radiation attenuation material and the spaces between the slats may be non-variable or variable.

28 Claims, 4 Drawing Sheets k = 0.282 k = 0.263

COLLIMATOR WITH VARIABLE FOCUSING AND DIRECTION OF VIEW FOR NUCLEAR MEDICINE IMAGING

BACKGROUND OF THE INVENTION

1. Field of the Invention

The present invention generally relates to nuclear medicine, and systems for obtaining nuclear medical images of a patient's body organs of interest. In particular, the present invention relates to a novel collimator with variable focusing and direction of view for nuclear medicine imaging, particularly for single photon imaging including single photon emission computed tomography (SPECT).

2. Description of the Background Art

Nuclear medicine is a unique medical specialty wherein radiation is used to acquire images that show the function and anatomy of organs, bones or tissues of the body. Radio pharmaceuticals are introduced into the body, either by injection or ingestion, and are attracted to specific organs, bones or tissues of interest. Such radio pharmaceuticals produce gamma photon emissions that emanate from the body. One or more detectors are used to detect the emitted gamma photons, and the information collected from the detector(s) is processed to calculate the position of origin of the emitted photon from the source (i.e., the body organ or tissue under study). The accumulation of a large number of emitted gamma positions allows an image of the organ or tissue under study to be displayed.

Single photon imaging, either planar or SPECT, relies on the use of a collimator placed between the source and a scintillation crystal or solid state detector, to allow only gamma rays aligned with the holes of the collimator to pass through to the detector, thus inferring the line on which the gamma emission is assumed to have occurred. Single photon imaging techniques require gamma ray detectors that calculate and store both the position of the detected gamma ray and its energy.

Two principal types of collimators have been used in nuclear medical imaging. The predominant type of collimation is the parallel-hole collimator. This type of collimator contains hundreds of parallel holes, which can be formed by casting, drilling, or etching of a very dense material such as lead. Parallel-hole collimators are most commonly attached near the detector (scintillator) with holes arranged perpendicular to its surface. Consequently, the camera detects only photons traveling nearly perpendicular to the scintillator surface, and produces a planar image of the same size as the source object. In general, the resolution of the parallel-hole collimator increases as the holes are made smaller in diameter and longer in length. The parallel-hole collimator offers greater sensitivity than a pinhole collimator, and its sensitivity does not depend on how closely centered the object is to the detector.

The conventional pinhole collimator typically is cone-shaped and has a single small hole drilled in the center of the collimator material. The pinhole collimator generates a magnified image of an object in accordance with its acceptance angle, and is primarily used in studying small organs such as the thyroid or localized objects such as a joint. The pinhole collimator must be placed at a very small distance from the object being imaged in order to achieve acceptable image quality. The pinhole collimator offers the benefit of high magnification of a single object, but loses resolution and sensitivity as the field of view (FOV) gets wider and the object is farther away from the pinhole.

Other known types of collimators include converging and diverging collimators. The converging collimator has holes that are not parallel; rather, the holes are focused toward the organ with the focal point being located in the center of the FOV. The image appears larger at the face of the scintillator using a converging collimator. For equivalent spatial resolution the converging collimator has higher sensitivity than the parallel-hole collimator. The gain in point sensitivity is obtained at the price of a reduced FOV. The diverging collimator results by reversing the direction of the converging collimator. The diverging collimator is typically used to enlarge the FOV, such as would be necessary with a portable camera having a small scintillator. The diverging collimator has a lower sensitivity than the parallel-hole collimator, especially with thick objects.

Another type of collimator is slat collimator that has been used with a rotating laminar emission camera, also known as the rotating laminar radionuclide camera. This camera has linear collimators usually formed by mounting parallel collimating plates or slats between a line of individual detectors. Alternately, individual detector areas of a large-area detector are defined and isolated through the placement of slats. The slat collimator isolates planar spatial projections; whereas, the grid collimator of traditional scintillation detectors isolates essentially linear spatial projections. The detector-collimator assembly of a slat camera is typically rotated about an axis perpendicular to the detector face in order to resolve data for accurate two-dimensional image projection. The projection data collected at angular orientations around the subject are reconstructed into a three-dimensional volume image representation.

While maintaining certain advantages, such as a better sensitivity-resolution compromise, over, e.g., traditional Anger cameras, slat detectors are burdened by some other undesirable limitations. For example, the one dimensional collimation or slat geometry used by slat detectors complicates the image reconstruction process. The slat geometry results in a plane integral reconstruction as opposed to the line integral reconstruction that is generally encountered in traditional Anger camera applications. Moreover, the geometry produces a plane integral only in a first approximation.

It is well known in the art that nuclear medicine imaging of small organs, such as brain, heart, kidneys, thyroid, and the like present special problems in collecting radiation emission and creating images from the collected data. Different systems including the use of the above described collimators have been used for nuclear imaging of small organs. Although images of such organs are routinely made, there remains a need for a system and methodology for improving imaging of small organs and for overcoming the shortcomings of the prior art, such as a novel collimator for a nuclear imaging camera and a method of forming the same.

SUMMARY OF THE INVENTION

The present invention solves the existing need by providing a new collimator geometry that enhances the imaging of small organs with high resolution or in an efficient manner. According to the present invention, a novel slat collimator for use in nuclear medicine imaging is provided. The slat collimator comprises a first layer comprising a plurality of spaced apart elongated slats and a second layer comprising a plurality of spaced apart elongated slats. The slats of the second layer are positioned orthogonally with respect to the slats of the first layer. The slats are constructed of a radiation attenuation material, such as tantalum, tungsten, lead and the like.

In one embodiment, the collimator is a static, i.e., the spaces between the slats are not variable. The spaces can be fixed by several means, including foam, grooves in the slats and guide plates.

In a second embodiment, the collimator is variable, i.e., the spaces between the slat can be varied. The spaces can be varied through several means, including springs, air bubbles and magnetic force. Pressure can be differentially applied to one end of a slat layer to control the pointing direction of the slats.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein:

FIG. 3A shows the slats being held apart by springs. FIG. 3B shows a further aspect in which the orientation of the slats is controlled by a motor applying pressure to one end of the slats.

FIG. 7A is a square hole collimator. FIG. 7B is a hexagonal hole collimator. FIG. 7C is the slat collimator of the present invention.

DETAILED DESCRIPTION OF PREFERRED EMBODIMENTS

The present invention is directed to a slat collimator that comprises two layers of slats. The present invention also describes a method of collimator fabrication using two stacks of slats. Also described are various techniques by which the angles of the slats can be varied to create non-parallel beam collimators. Such collimators may be advantageous in SPECT studies of small organs, such as brain, heart, kidney, thyroid, etc. The convergence of the collimator can be changed to adapt for each study. Also, the convergence can be changed in a SPECT study as the distance from the camera to the organ changes during the scan. For a given spatial resolution, the gain of sensitivity with 2D-convergence will dominate the small sensitivity loss due to the extra collimator thickness relative to a conventional hole collimator. The slat collimator of the present invention is used on a scintillation camera of the type which is used to carry out SPECT studies, i.e., is used with a nuclear imaging acquisition system for SPECT studies. The nuclear imaging acquisition system comprises the slat collimator described herein and a detector having a side which detects radiation emanating from an object after passing through said collimator.

Figure 1:
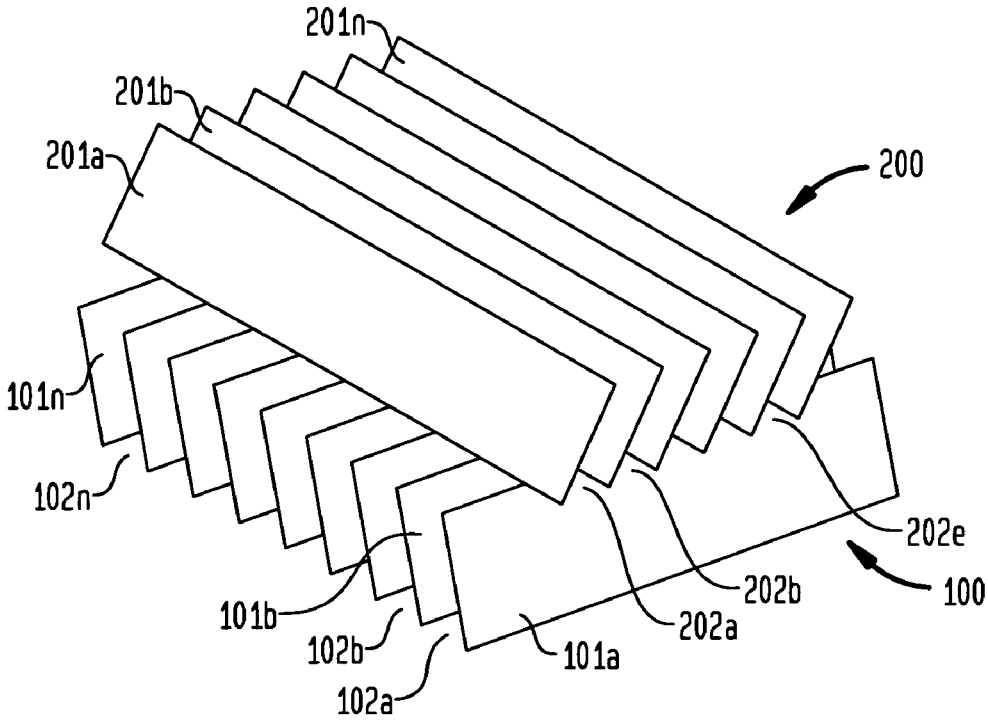
FIG. 1 shows a collimator according to the present invention.

As shown in FIG. 1, a collimator in accordance with the present invention comprises two stacks of slats. The collimator comprises a first layer (100) of a plurality of elongated spaced apart slats (101*a*, 101*b*, . . . 101*n*) and a second layer (200) of a plurality of elongated spaced apart slats (201*a*, 201*b*, . . . 201*n*). The second layer (200) is positioned orthogonally with respect to said first layer (100). The slat material should be a suitable gamma ray attenuator, e.g., tantalum, tungsten, lead, etc. The slats (101*a*, 101*b*, . . . 101*n*) of the first layer (100) may be perpendicular to the surface of detector (not shown) or they may be at an angle greater than zero. All of the slats (101*a*, 101*b*, . . . 101*n*) in the first layer (100) are angled in the same direction. Similarly, the slats (201*a*, 201*b*, . . . 201*n*) of the second layer (200) may be perpendicular to the surface of the first layer (100) or they may be at an angle greater than zero. All of the slats (201*a*, 201*b*, . . . 201*n*) in the second layer (200) are angled in the same direction. By constructing collimators from two orthogonal layers of slats, similar to "Venetian blinds", a very general collimation viewing configuration is realized.

In one embodiment, the spaces (102*a*, 102*b*, . . . 102*n*) between the slats (101*a*, 101*b*, . . . 101*n*) in the first layer (100) are non-variable, i.e., fixed to produce static (non-variable) collimation. Similarly, the spaces (202*a*, 202*b*, . . . 202*n*) between the slats (201*a*, 201*b*, . . . 201*n*) in the second layer (200) are non-variable, i.e., fixed.

In one aspect of this embodiment, the spaces (102*a*, 102*b*, . . . 102*n*; 202*a*, 202*b*, . . . 202*n*) between the slats (101*a*, 101*b*, . . . 101*n*; 201*a*, 201*b*, . . . 201*n*) can be filled with a low density foam materials, such as ROHACELL® rigid plastic foam material.

In a second aspect, air spaces between slats could be used if slats are sufficiently rigid. The spacing of the slats (101*a*, 101*b*, . . . 101*n*; 201*a*, 201*b*, . . . 201*n*) can be fixed by mounting the slats into grooves (not shown) on the top edge of the slats (101*a*, 101*b*, . . . 101*n*) of the first layer (100) and on the bottom edge of the slats (201*a*, 201*b*, . . . 201*n*) of the second layer (200).

Figure 2:
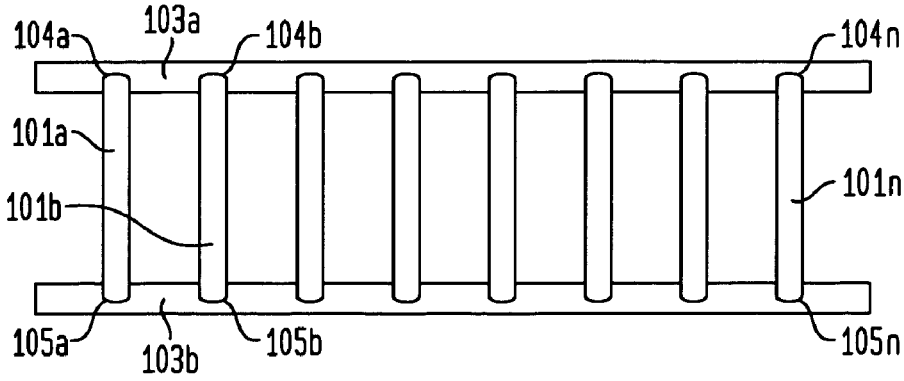
FIG. 2 shows one method for constructing each layer of a collimator according to the present invention in which the slats are held in place by guide plates.

In a third aspect, the spacing of the slats (101*a*, 101*b*, . . . 101*n*; 201*a*, 201*b*, . . . 201*n*) can be fixed by mounting the slats into grooves of slide guide plates. FIG. 2 is a cross-section view of the construction of one layer, e.g., first layer (100) using slide guide plates. As shown in FIG. 2, two slide guide plates (103*a*, 103*b*) are provided. The slide guide plates (103*a*, 103*b*) have grooves (104*a*, 104*b* . . . 104*n*; 105*a*, 105*b*, . . . 105*n*) on their inside edges into which the slats (101*a*, 101*b*, . . . 101*n*) are positioned. The slide guide plates (103*a*, 103*b*) are constructed out of low radiation attenuation material, such as aluminum or plastic. It can be appreciated that the spaces between slats (201*a*, 201*b*, . . . 201*n*) of the second layer (200) can be fixed in the same manner.

In a second embodiment the spaces (102*a*, 102*b*, . . . 102*n*) between the slats in the first layer (100) can be varied.

Similarly, the spaces (202*a*, 202*b*, . . . 202*n*) between the slats in the second layer (200) can be varied. As used herein, variable spaces is intended to mean that the distance between the slats (101*a*, 101*b*, . . . 101*n*; 201*a*, 201*b*, . . . 201*n*) at one end of said slates is less than the distance between slats at the other end of said slats. By varying the spaces between the slats in this manner, non-parallel beam collimators are created. In addition, the direction of view can be changed using such a variable collimator. In order for direction of view to be changed in a general manner, a means creating repulsive forces between the slats needs to be created.

Figure 3A:
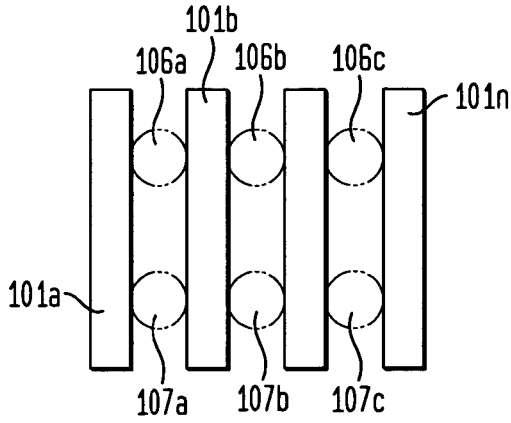
FIGS. 3A and 3B show one embodiment of a variable collimator in which the slats are held apart by springs.
Figure 3B:
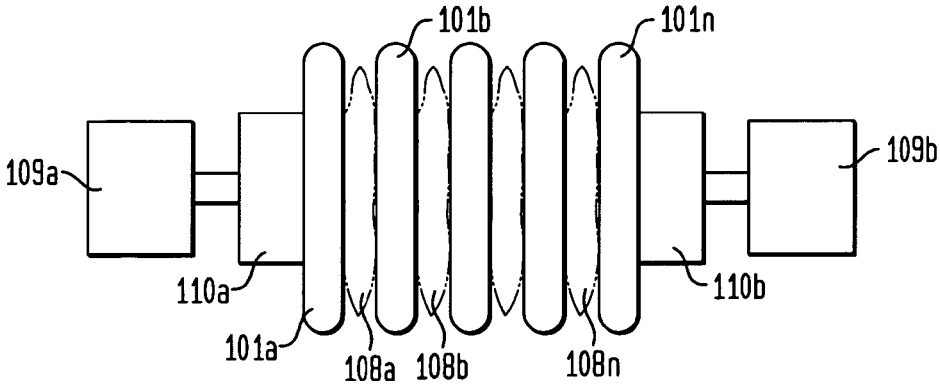

In one aspect of this embodiment, the slats (101*a*, 101*b*, . . . 101*n*; 201*a*, 201*b*, . . . 201*n*) can be held apart by springs. As shown in FIG. 3A, the slats (101*a*, 101*b*, . . . 101*n*) are held apart by springs (106*a*, 106*b*, 106*c*) at one end of the first layer (100) and springs (107*a*, 107*b*, 107*c*) at the other end of the first layer (100). The pointing direction of the slats (101*a*, 101*b*, . . . 101*n*) may be controlled by setting the orientation of slats at either end of the layer, such as by using springs of different sizes or by applying a force at either end of the layer. For example, springs (107*a*, 107*b*, 107*c*) may be larger than springs (106*a*, 106*b*, 106*c*) such that a direction of collimation of radiation is achieved. Alternatively, as shown in FIG. 3B, single springs (108*a*, 108*b*, . . . 108*n*) can be used between the slats (101*a*, 101*b*, . . . 101*n*). By applying a force to one end of the slats (101*a*, 101*b*, . . . 101*n*) in the first layer (100), direct directional control of the source slats between the ends of the array can be provided. As shown in FIG. 3B, such force can be applied by motors (109*a*, 109*b*) that push plates (110*a*, 110*b*) into one end of the slats (101*a*, 101*b*, . . . 101*n*) to provide directional control. In addition, by tilting the end slats the direction of view of the array can be deflected or focused. It can be appreciated that springs and similar direct directional control can be performed for the slats (201*a*, 201*b*, . . . 201*n*) of the second layer (200). It can further be appreciated that the directional control can be applied to only one or both of the layers of the slats.

Figure 4:
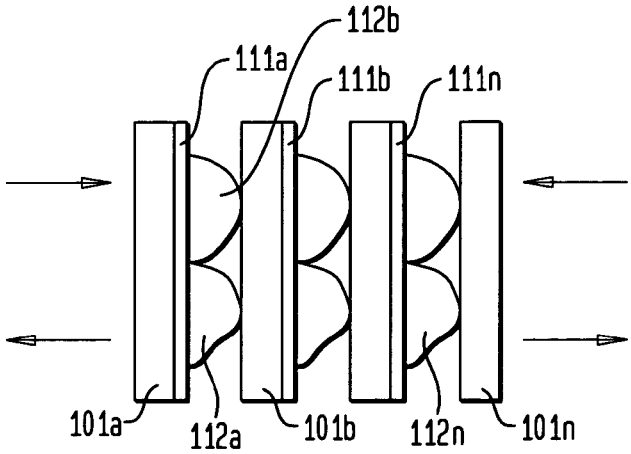
FIG. 4 shows one embodiment of a variable collimator in which the slats are held apart by air bubbles in a plastic material.

In a second aspect, slats could be held apart by a bubble-wrap between the slats. As shown in FIG. 4, slats (101*a*, 101*b*, . . . 101*n*) of the first layer (100) are separated by plastic (111*a*, 111*b*, . . . 111*n*) that contains bubbles (112*a*, 112*b*, . . . 112*n*) of air. By tilting the end slats, such as described above and as shown by the arrows in FIG. 4, the direction of view of the array can be deflected or focused. It can be appreciated that bubble-wrap and similar direct directional control can be performed for the slats (201*a*, 201*b*, . . . 201*n*) of the second layer (200). It can further be appreciated that the directional control can be applied to only one or both of the layers of the slats.

Figure 5:
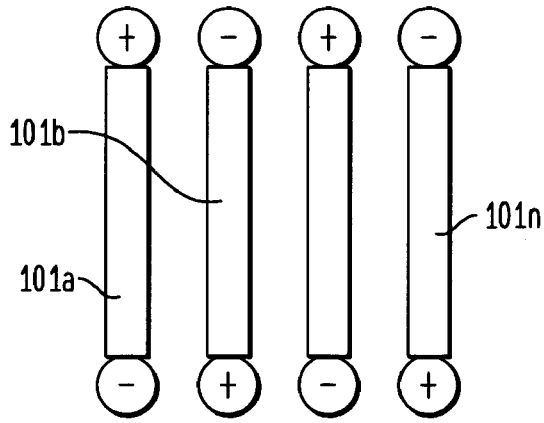
FIG. 5 shows one embodiment of a variable collimator in which the slats are held apart by magnetic force.

In a third aspect, slats (101*a*, 101*b*, . . . 101*n*) of the first layer (100) could be held apart magnetically. As shown in FIG. 5, each slat (101*a*, 101*b* . . . 101*c*) is encompassed by a current loop. The loop wires (not shown) are attached to the slats (101*a*, 101*b*, . . . 101*n*). Alternate slats (e.g., 101*a* and 101*b*) have the current flowing in the opposite sense, as shown by the + and − in FIG. 5. The opposite current flow sets up a repulsive magnetic force between the slats. By tilting the end slats, such as described above, the direction of view of the array can be deflected or focused. It can be appreciated that magnetic repulsion and similar direct directional control can be performed for the slats (201*a*, 201*b*, . . . 201*n*) of the second layer (200). It can further be appreciated that the directional control can be applied to only one or both of the layers of the slats.

In a third embodiment, the spaces in one layer, e.g., spaces (102*a*, 102*b*, . . . 102*n*) between the slats in the first layer (100) are non-variable, i.e., fixed, such as described above. The spaces in a second layer, e.g. spaces (202*a*, 202*b*, . . . 202*n*) between the slats in the second layer (200) can be varied and under direct directional control, such as described above. Alternatively, the spaces (102*a*, 102*b*, . . . 102*n*) between the slats in the first layer (100) can be varied and under direct directional control. The spaces in a second layer, e.g. spaces (202*a*, 202*b*, . . . 202*n*) between the slats in the second layer (200) are non-variable, i.e., fixed.

By varying the spaces between the slats in this manner, non-parallel beam collimators are created. Such collimators may be advantageous in SPECT studies of small organs, such as brain, heart, kidney, thyroid, etc. The convergence of the collimator can be changed to adapt for each study. Also, the convergence can be changed in a SPECT study as the distance from the camera to the organ changes during the scan. To image a small organ (or region-of-interest), it is desireable to spend a greater share of the available scan time and a greater share of the available detector area detecting photons mainly from this area. An initial fast SPECT scan (or the use of two orthogonal views) would give enough information to allow the position of the organ-of-interest (ROI) to be determined. Using this position information, the collimator can be dynamically focused on the ROI during the scan for a large fraction of the total study time.

Although the slat collimation system of the present invention has some drawbacks, particularly in static configuration, in comparison to foil or cast collimator, it has several advantages. The drawbacks include:

The static system will be thicker (at least double) than a conventional collimator. Thus, for a given special resolution, the sensitivity will be somewhat reduced, approximately by the square of the ratio of distances from source to detector (scintillation crystal).

It is made out of more costly materials.

It has more complex control and calibration.

Figure 6A:
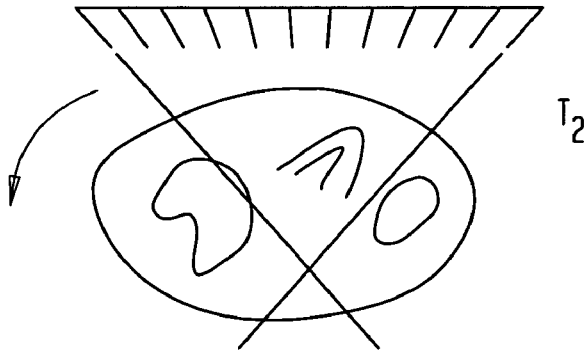
FIGS. 6A and 6B are an illustration of the variable slat system which show that this system can yield overall improvements in imaging speed and higher sensitivity.
Figure 6B:
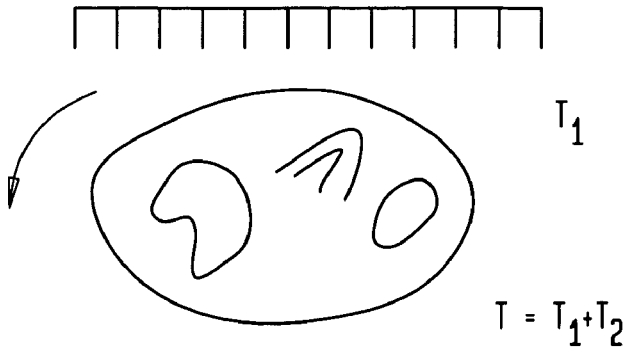

The advantages include:

For SPECT imaging of organs or regions significantly smaller than the typical camera field of view (FOV), the variable slat system can yield overall improvements in imaging speed (higher sensitivity). As shown in FIGS. 6A and 6B, the SPECT acquisition change have two phases of differing durations, $T_1$ and $T_2$. For imaging a small organ it will be advantageous to dynamically focus on the organ-of-interest for time $T_2$ and image the entire object (no truncation) for another time period $T_1$. Generally, $T_2$ is much greater than $T_1$, since the untruncated data is only needed to form the image of the organ surround at lower resolution. A SPECT acquisition commonly consists of a multiplicity of different views. Each view is defined by a specification camera position of orientation. The i-th view may have focused and unfocused temporal phases $T_{2i}$ and $T_{1i}$.

The system can focus collimators so that more (most) of the time is spent acquiring counts from the organ or region of interest and less time spent acquiring counts from the overall background.

Focus can controlled to provide tight focusing on organ of interest without truncation. The focus could also be offset with respect to the center of the collimator. The use of quick prescan SPECT study, perhaps only two orthogonal planar views can suffice in many cases, allows the organ of interest to be located. Position encoders on the camera system give the position and angular orientation of each camera head (detector).

Using this information together of the prescan data permits determination of the organ position for tight, dynamic focusing on the organ for the remainder of the scan. The focus of the slat collimator does not necessary have to be centered, but can be offset. This can be achieved by means of non-symmetric orientation and drive of the push plates (110*a*, 110*b*), see FIG. 3B.

Figure 7A:
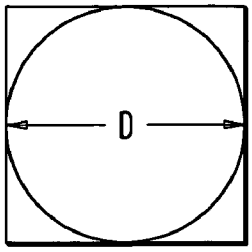
FIGS. 7A-7C show collimator types in the context of sensitivity considerations.
Figure 7B:
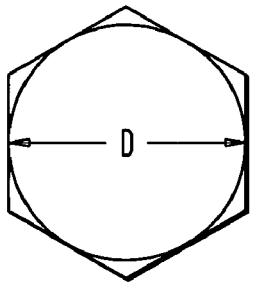

As disclosed above, the variable slat system can yield overall improvements in sensitivity. There are several sensitivity considerations that can be envisioned. The sensitivity (solid angle) of a convention 2D-hole collimator is given by the equation $$\Omega = \left[\frac{kD^2}{L(D+S)}\right]^2 \quad \text{(Eq. 1)}$$

where k is a form factor depending on hold shape, D is the size of the hole (~across "flats" dimension), S is septal thickness and L is light. (Anger, H. O. (1964), "Scintillation Camera with Multichannel Collimators." *J Nucl Med* 5:515-531.) FIG. 7A shows D and k for a square hole. FIG. 7B shows D and k for a hexagonal hole.

Figure 7C:
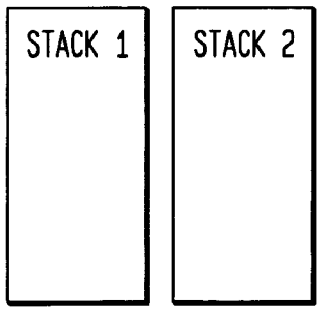

In a stack slat collimator system, the main factor degrading sensitivity for a fixed spatial resolution will be the increased distance of the object from the camera due to the increased thickness of the collimator. The sensitivity of the stacked slat (shown representatively in FIG. 7C in which stack 1 is layer (100) and stack 2 is layer (200) will be approximately $$\Omega = \theta_1\theta_2 = \left[\frac{k_1 D_1^2}{L_1(D_1+S_1)}\right]\left[\frac{k_2 D_2^2}{L_2(D_2+S_2)}\right] \quad \text{(Eq. 2)}$$

where $k_1 \approx k_2 = \sqrt{k}$

The angular sorting in x and y direction is separable and for $L_1=L_2=L$, $D_1=D_2=D$, $S_1=S_2=S$, the net solid angle of the stack collimator is approximately the same for a conventional collimator given by Eq. 1.

Figure 8:
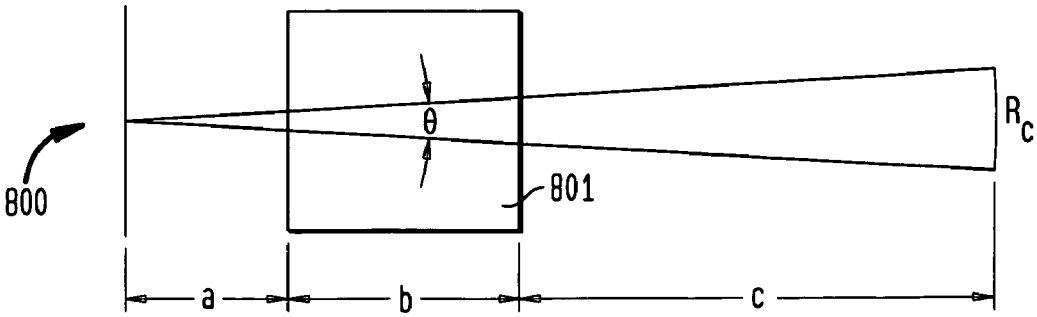
FIG. 8 is an illustration of the collimator spatial resolution showing the collimator angle.

For a fixed collimator spatial resolution, the collimator angle (shown in FIG. 8 as θ) is $$\theta = \frac{R_c}{(a+b+c)} \quad \text{(Eq. 3)}$$

where a is the distance from the mean detection plane (in the scintillation crystal) (800) to the collimator (801), b is thickness of the collimator (801), and c is the distance from the collimator (801) to the object. $R_c$ is the geometric spatial resolution of the collimator.

If $R_c$, a and c are held fixed, then an increase of b implies a decrease in θ and a decrease in sensitivity.

$\Omega_1 \approx \theta^2$ for conventional collimators $\Omega_2 = \theta_x\theta_y$ for stacked (layers of slats) collimator $$\left(\frac{\Omega_2}{\Omega_1}\right) = \frac{\theta_x\theta_y}{\theta^2} = \left(\frac{a+b_1+c}{a+b_2+c}\right)^2$$

For typical values: a=0.5 cm, c=20 cm, $b_1$=2.5 cm, $b_2>2b_1$ or $b_2=2b_1$ (best case)

$$\left(\frac{\Omega_2}{\Omega_1}\right) = \left(\frac{23}{25.5}\right)^2 = 0.81$$

For c=16 cm (reasonable for brain imaging)

$$\left(\frac{\Omega_2}{\Omega_1}\right) = \left(\frac{19}{21.5}\right)^2 \approx 0.78$$

Thus, with a 2D-converging slat system according to the present invention, a magnification gain >2 could easily be obtained. Hence, the small loss of sensitivity due to increased thickness of the collimator is more than offset by the gain in magnification.

For SPECT imaging of organs or regions significantly smaller than the typical camera field of view (FOV), the variable slat system can yield overall improvements in imaging speed (higher sensitivity). As shown in FIGS. 6A and 6B, the SPECT acquisition can have two phases of differing durations, $T_1$ and $T_2$. For imaging a small organ it will be advantageous to dynamically focus on the organ-of-interest for time $T_2$ and image the entire object (no truncation) for another time period $T_1$. Generally, $T_2$ is much greater than $T_1$, since the untruncated data is only needed to form the image of the organ surround at lower resolution. A SPECT acquisition commonly consists of a multiplicity of different views. Each view is defined by a specification camera position of orientation. The i-th view may have focused and unfocused temporal phases $T_{2i}$ and $T_{1i}$.

While a preferred embodiment of the present invention has been described above, it should be understood that it has been presented by way of example only, and not limitation. Thus, the breadth and scope of the present invention should not be limited by the above described exemplary embodiment.

Obviously, numerous modifications and variations of the present invention are possible in light of the above teachings. It is therefore to be understood that the invention may be practiced otherwise than as specifically described herein.

As disclosed above, the variable slat system can yield overall improvements in sensitivity. There are several sensitivity considerations that can be envisioned. The sensitivity (solid angle) of a convention 2D-hole collimator is given by the equation $$\Omega = \left[\frac{kD^2}{L(D+S)}\right]^2 \quad \text{(Eq. 1)}$$

where k is a form factor depending on hole shape, D is the size of the hole (~across "flats" dimension), S is septal thickness and L is light. (Anger, H. O. (1964), "Scintillation Camera with Multichannel Collimators." J NucI Med 5:515-531.) FIG. 7A shows D and k for a square hole. FIG. 7B shows D and k for a hexagonal hole.

The invention claimed is:

1. A collimator for use in single photon emission computed tomography (SPECT), which collimator comprises:

a first layer comprising at least three spaced apart elongated slats forming a first array extending in a first direction; and a second layer comprising at least three spaced apart elongated slats forming a second array extending in a second direction orthogonal to said first direction, said first array having a width extending across said second direction, said second array having a width extending across said first direction, wherein each elongated slat of each array has a length extending across the entire width of the other array, each of said slats constructed of a radiation attenuation material.

2. The collimator of claim 1, wherein the space between said slats is fixed and non-variable.

3. The collimator of claim 2, wherein the space between said slats is fixed by foam.

4. The collimator of claim 2, wherein the space between said slats is fixed by guide plates having grooves into which ends of said slats are positioned.

5. The collimator of claim 2, wherein the space between said slats is fixed by grooves in the top of said first layer and grooves in the bottom of said second layer.

6. The collimator of claim 2, wherein each of said slats in a layer are tilted at an angle greater than zero and all of said slats in a layer are tilted in the same direction.

7. The collimator of claim 1, wherein the space between said slats is variable.

8. The collimator of claim 7, wherein the space between said slats at one end of said slats is less than the space between said slats at the other end of said slats.

9. The collimator of claim 8, wherein the space between the slats is varied by application of a force to both sides of the layer at one end of said slats.

10. The collimator of claim 8, wherein each of said slats in a layer are tilted at an angle greater than zero and all of said slats in a layer are tilted in the same direction.

11. The collimator of claim 7, wherein the space between said slats is varied through use of springs.

12. The collimator of claim 7, wherein the space between said slats is varied through use of plastic having air bubbles.

13. The collimator of claim 7, wherein the space between said slats is varied through use of magnetic force.

14. The collimator of claim 1, wherein each of said slats in a layer are tilted at an angle greater than zero and all of said slats in a layer are tilted in the same direction.

15. A nuclear imaging acquisition system for use in single photon emission computed tomography (SPECT), which system comprises:

a collimator comprising a first layer comprising at least three spaced apart elongated slats forming a first array extending in a first direction and a second layer comprising at least three spaced apart elongated slats forming a second array extending in a second direction orthogonal to said first direction, said first array having a width extending across said second direction, said second array having a width extending across said first direction, wherein each elongated slat of each array has a length extending across the entire width of the other array, each of said slats constructed of a radiation attenuation material; and a detector having a side which detects radiation emanating from an object after passing through said collimator.

16. The nuclear imaging acquisition system of claim 15, wherein the space between said slats is fixed and non-variable.

17. The nuclear imaging acquisition system of claim 16, wherein the space between said slats is fixed by foam.

18. The nuclear imaging acquisition system of claim 16, wherein the space between said slats is fixed by guide plates having grooves into which ends of said slats are positioned.

19. The nuclear imaging acquisition system of claim 16, wherein the space between said slats is fixed by grooves in the top of said first layer and grooves in the bottom of said second layer.

20. The nuclear imaging acquisition system of claim 16, wherein each of said slats in a layer are tilted at an angle greater than zero and all of said slats in a layer are tilted in the same direction.

21. The nuclear imaging acquisition system of claim 15, wherein the space between said slats is variable.

22. The nuclear imaging acquisition system of claim 21, wherein the space between said slats at one end of said slates is less than the space between said slats at the other end of said slats.

23. The collimator of claim 22, wherein the space between the slats is varied by application of a force to both sides of the layer at one end of said slats.

24. The nuclear imaging acquisition system of claim 21, wherein the space between said slats is varied through use of springs.

25. The nuclear imaging acquisition system of claim 21, wherein the space between said slats is varied through use of plastic having air bubbles.

26. The nuclear imaging acquisition system of claim 21, wherein the space between said slats is varied through use of magnetic force.

27. The nuclear imaging acquisition system of claim 21, wherein each of said slats in a layer are tilted at an angle greater than zero and all of said slats in a layer are tilted in the same direction.

28. The nuclear imaging acquisition system of claim 15, wherein each of said slats in a layer are tilted at an angle greater than zero and all of said slats in a layer are tilted in the same direction.

* * * * *